US007603936B2

(12) United States Patent
Pryor et al.

(10) Patent No.: US 7,603,936 B2
(45) Date of Patent: Oct. 20, 2009

(54) LOAF SEAM SYNCHRONIZATION DEVICE FOR CONTINUOUS LOAF FEED SLICING MACHINE

(75) Inventors: Glen F. Pryor, Mokena, IL (US); Glenn Sandberg, New Lenox, IL (US)

(73) Assignee: Formax, Inc., Mokena, IL (US)

( * ) Notice: Subject to any disclaimer, the term of this patent is extended or adjusted under 35 U.S.C. 154(b) by 0 days.

(21) Appl. No.: 11/174,098

(22) Filed: Jul. 1, 2005

(65) Prior Publication Data

US 2006/0196328 A1 Sep. 7, 2006

Related U.S. Application Data

(60) Provisional application No. 60/659,345, filed on Mar. 5, 2005.

(51) Int. Cl.
*B26D 7/06* (2006.01)

(52) U.S. Cl. ..... 83/567; 83/409; 83/422; 83/277; 83/932

(58) Field of Classification Search ..... 83/409, 83/409.1, 422, 932, 567, 277, 42, 206, 435.17, 83/355, 420, 418, 415, 717
See application file for complete search history.

(56) References Cited

U.S. PATENT DOCUMENTS 2,036,001 A * 3/1936 Walter ..... 83/88
3,708,055 A * 1/1973 Miller et al. ..... 198/444
3,894,457 A 7/1975 Miller et al.
4,457,194 A * 7/1984 Mally ..... 83/42
4,512,228 A * 4/1985 Tarcisio ..... 83/355
4,552,049 A * 11/1985 Matzinger et al. ..... 83/27
4,583,435 A 4/1986 Fessler
4,644,729 A 2/1987 Fessler
4,934,232 A * 6/1990 Weber et al. ..... 83/355
4,991,477 A * 2/1991 Butt et al. ..... 83/35
5,191,820 A 3/1993 Hartmann
5,482,166 A * 1/1996 Brown ..... 209/580
5,628,237 A 5/1997 Lindee et al.
5,775,190 A * 7/1998 Terai ..... 83/92
5,974,925 A 11/1999 Lindee et al.
6,484,615 B2 11/2002 Lindee
2002/0083816 A1 7/2002 Krauss (Continued)

FOREIGN PATENT DOCUMENTS

DE 3912445 10/1990

(Continued)

*Primary Examiner*—Boyer D. Ashley
*Assistant Examiner*—Laura M. Lee
(74) *Attorney, Agent, or Firm*—Erickson Law Group, PC

(57) ABSTRACT

A mechanism and method is provided for controllably loading multiple food loaves into the slicing station of a continuous slicing machine. The parallel loaves that are engaged by a common loaf feed drive or side-by-side, independent loaf feed drives are engaged by the loaf feed drive or drives simultaneously such that the interface or seam between a preceding loaf and a trailing loaf in different loaf feed paths are located substantially at the same location during slicing of two side-by-side loaf streams. A clamp device is provided that clamps multiple food loaves when loaded to move along the parallel food loaf paths together, wherein the clamp device can be released once the multiple food loaves are simultaneously engaged by the loaf feed drive.

15 Claims, 7 Drawing Sheets

U.S. PATENT DOCUMENTS

| | | | |
|---|---|---|---|
| 2004/0211302 | A1 | 10/2004 | Weber |
| 2005/0132855 | A1 | 6/2005 | Weber |

FOREIGN PATENT DOCUMENTS

| | | |
|---|---|---|
| DE | 3912446 | 10/1990 |
| DE | 4113435 | 10/1992 |
| DE | 3612996 | 7/2006 |
| EP | 412295 | 2/1991 |
| EP | 547389 | 6/1993 |

* cited by examiner

LOAF SEAM SYNCHRONIZATION DEVICE FOR CONTINUOUS LOAF FEED SLICING MACHINE

This application claims the benefit of U.S. Provision Application Serial No. 60/659,345 filed Mar. 5, 2005.

BACKGROUND OF THE INVENTION

Many different kinds of food loaves are produced; they come in a wide variety of shapes and sizes. There are meat loaves made from various different meats, including ham, pork, beef, lamb, turkey, and fish. The meat in the food loaf may be in large pieces or may be thoroughly comminuted. These meat loaves come in different shapes (round, square, rectangular, oval, etc.) and in different lengths up to four feet (122 cm) or even longer. The cross-sectional sizes of the loaves are quite different; the maximum transverse dimension may be as small as 1.5 inches (4 cm) or as large as ten inches (25.4 cm). Loaves of cheese or other foods come in the same great ranges as to composition, shape, length, and transverse size.

Typically the food loaves are sliced, the slices are grouped in accordance with a particular weight requirement, and the groups of slices are packaged and sold at retail. The number of slices in a group may vary, depending on the size and consistency of the food loaf and the desire of the producer, the wholesaler, or the retailer. For some products, neatly aligned stacked slice groups are preferred. For others, the stacks are shingled so that a purchaser can see a part of every slice through a transparent package.

Food loaves can be sliced on high speed slicing machines such as disclosed in U.S. Pat. Nos. 5,628,237 or 5,974,925 or as commercially available as the FX180™ slicer available from Formax, Inc. of Mokena, Ill., USA.

The FX180™ machine can be configured as an automatically loaded, continuous feed machine. In the FX180™ machine, side-by-side upper and lower conveyor pairs drive loaves into the cutting plane. A gate is located in front of the conveyors. The initial loaves are loaded with leading ends abutting the gate. The gate is lowered and the loaves proceed into the conveyors. When the initial loaves are sliced to the extent that the trailing ends of the loaves clear the gate, the gate is raised and new loaves are loaded in the feed paths, held back by the gate. Shortly thereafter the gate is lowered and new loaves slide down to where lead ends of the new loaves abut trailing ends of the initial loaves being sliced. The new loaves are driven into the cutting plane trailing the initial loaves. Loaves are sequentially and continuously loaded in this manner, lead end-to-trailing end, in abutting contact with the preceding loaves.

One problem associated with this arrangement is the fact that when multiple loaves are initially loaded into the machine, without preceding loaves being present, individual loaves can be inadvertently longitudinally offset due to the drive conveyors gripping and driving the loaves at varying moments. This causes all subsequently loaded loaves to be offset as well. The seam location typically does not slice as neatly as the rest of the loaves. It simplifies production if the longitudinal seam location for all side-by-side loaf streams is at the same location, particularly if slices at the seam location are to be discarded or recycled.

SUMMARY OF THE INVENTION

The invention provides a mechanism and method for controllably loading multiple food loaves into the slicing station of a continuous slicing machine. The mechanism and method of the invention provides that parallel loaves that are engaged by a common loaf feed drive or side-by-side, independent loaf feed drives are engaged by the loaf feed drive or drives simultaneously such that the interface or seam between a preceding loaf and a trailing loaf in different loaf feed paths are located substantially at the same location during slicing of two side-by-side loaf streams. Since the cut slices at this location are more likely to be ragged or unsightly, it simplifies production if this seam location occurs at the same location during slicing of two parallel food loaf streams. The mechanism and method of the invention provides a clamp device that clamps multiple food loaves when loaded to move along the parallel food loaf paths together, wherein the clamp device can be released once the multiple food loaves are simultaneously engaged by the loaf feed drive. This prevents side-by-side loaves from being engaged by the loaf feed drive at slightly different times which tends to offset the ends of the loaves, which results in seam locations in side-by-side streams of slices being different.

The invention provides a high speed food loaf slicing machine that includes a slicing station that includes a knife blade and a knife blade drive that drives the knife blade along a predetermined cutting path. The invention provides a loaf support for supporting a first food loaf and a second food loaf for movement along parallel first and second loaf paths, respectively, into the slicing station for repetitive slicing of both loaves by the knife blade. A loaf feed drive is arranged for advancing the first food loaf and the second food loaf along the loaf path. According to the invention a clamp device is arranged to clamp the first and second loaves on the first and second loaf paths. The clamp device is arranged to translate on the first and second loaf paths to move from a home position for receiving the first and second loaves to a feed position closer to the cutting path wherein ends of the first and second loaves are engaged by the loaf feed drive.

The invention provides a high speed food loaf slicing machine that includes a loaf storage tray for storing the first and second food loaves ready for transfer to the first and second loaf path, and loaf transfer means for moving the first and second food loaves from the loaf storage tray to the first and second loaf paths.

The invention also provides that the clamp device comprises a carriage that is arranged to translate along the first and second loaf paths on at least one elongated guide member. The clamp device also can include at least one pneumatic cylinder having a press member and mounted to the carriage, and a stop member mounted to the carriage. At least one of the first and second loaves are located between the stop member and the press member. The pneumatic cylinder is actuatable to clamp at least one of the first and second loaves between the stop member and the press member Preferably the clamp device comprises a pair of pneumatic cylinders, each having a press member and each mounted to the carriage, the first and second loaves located between the stop member and the press members. The pneumatic cylinders are actuatable to clamp the first and second loaves between the stop member and the press members.

Preferably the clamp device comprises a carriage-drive pneumatic cylinder connected to the carriage and to the machine frame, actuation of the carriage-drive pneumatic cylinder driving the carriage in the direction from the feed position to the home position.

Preferably the stop member comprises an L-shaped bar having a horizontal leg disposed over the first and second loaves, and a vertical leg connected to the carriage. The L-shaped bar forms a lateral clearance or opening with the carriage to permit the lateral introduction of the first and second loaves into the first and second loaf paths.

The invention can further provide a loaf gate disposed between the first and second loaves and the loaf feed drive when the carriage is in the home position. In operation, after the loaves are loaded, leading ends of the first and second loaves press against the loaf gate. The loaf gate is actuatable to dear the first and second loaf paths to permit the first and second loaves to proceed toward the loaf feed drive, as the carriage translates along the first and second loaf paths.

The invention is particularly useful when the loaf storage tray and the loaf transfer means constitute an automated loaf loading mechanism, located on one side of the slicing machine. The loaf transfer means preferably comprises a tilt mechanism for tilting the tray and raising trailing ends of loaves held thereon, and a translation mechanism for shifting loaves held thereon along the loaf tray to an overall raised elevation.

The invention provides an inventive method including the steps of:

driving a knife blade along a predetermined cutting path;

supporting a first food loaf and a second food loaf for movement along parallel first and second loaf paths, respectively, into the cutting path for repetitive slicing of both loaves by the knife blade;

providing a loaf feed drive for advancing the first food loaf and the second food loaf along the loaf path into the cutting path;

clamping the first and second loaves together on the first and second loaf paths;

translating the first and second loaves along the first and second loaf paths to move from a home position to a feed position closer to the cutting path wherein leading ends of the first and second loaves are engaged by the loaf feed drive;

unclamping the first and second loafs; and advancing the first food loaf and the second food loaf along the loaf path into the cutting path.

The invention can also include the steps of:

storing the first and second food loaves on a surface ready for transfer to the first and second loaf paths; and sweeping the first and second food loaves from the surface to the first and second loaf paths.

The invention can also include the steps of: arranging a loaf gate disposed between the first and second loaves and the loaf feed drive before the first and second loaves are clamped, leading ends of the first and second loaves pressing against the loaf gate, actuating the loaf gate to clear the first and second loaf paths to permit the first and second loaves to proceed toward the loaf feed drive.

Numerous other advantages and features of the present invention will be become readily apparent from the following detailed description of the invention and the embodiments thereof, and from the accompanying drawings.

DESCRIPTION OF THE PREFERRED EMBODIMENTS

Figure 1:
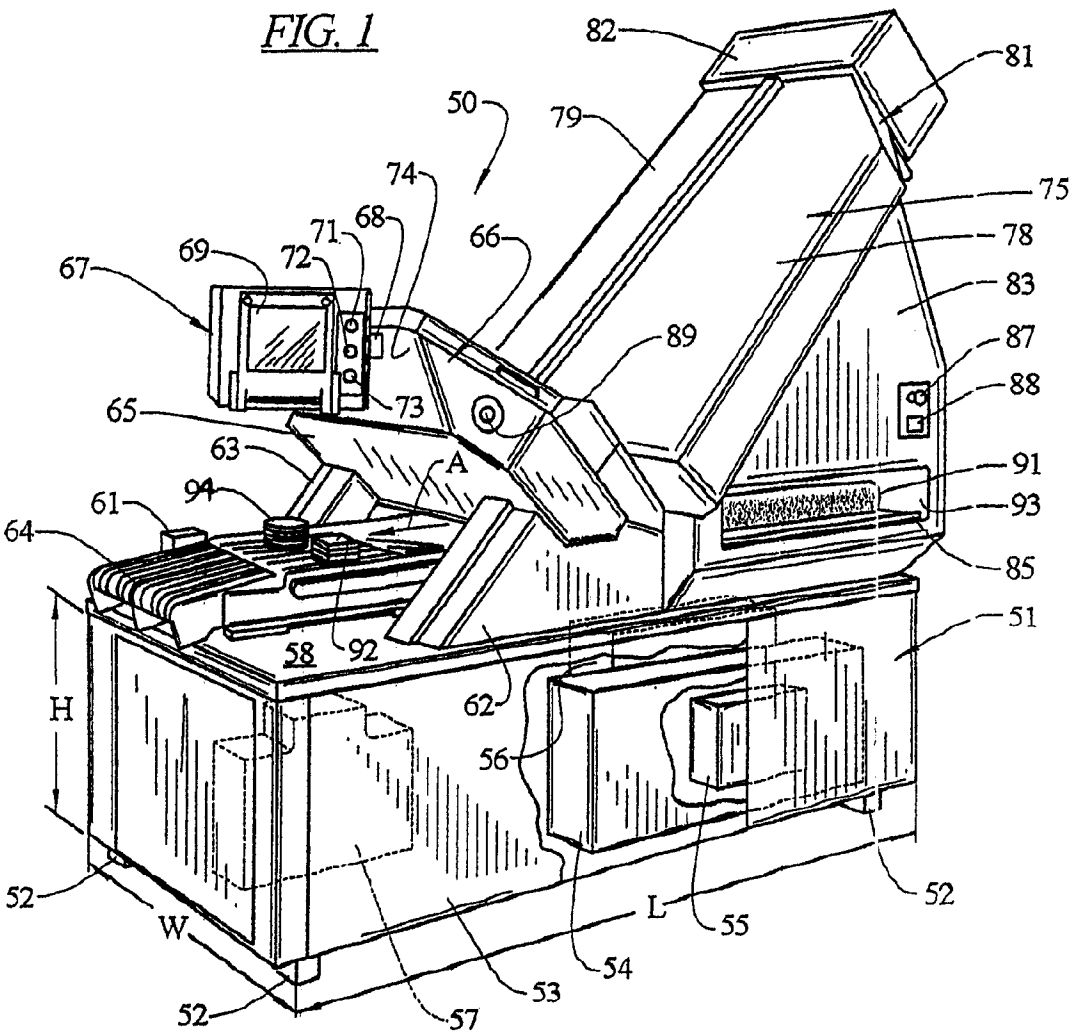
FIG. 1 is a perspective view of a slicing machine comprising a preferred embodiment of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a food loaf slicing machine 50 of the invention. The slicing machine can be constructed in accordance with U.S. Pat. Nos. 5,628,237 or 5,974,925 herein incorporated by reference and modified for continuous loaf feed and automatic loading, such as is commercially available as the FX180™ slicer available from Formax, Inc. of Mokena, Ill., U.S.A. Slicing machine 50 comprises a base 51 which is mounted upon four fixed pedestals or feet 52 (three of the feet 52 appear in FIG. 1) and has a housing or enclosure 53 surmounted by a top 58. Base 51 typically affords an enclosure for a computer 54, a low voltage supply 55, a high voltage supply 56, and a scale mechanism 57. Base enclosure 53 may also enclose a pneumatic supply or a hydraulic supply, or both (not shown).

Slicing machine 50, as seen in FIG. 1, includes a conveyor drive 61 utilized to drive an output conveyor/classifier system 64. There is a front side guard 62 extending upwardly from the top 58 of base 51 at the near side of the slicing machine 50 as illustrated in FIG. 1. A similar front side guard 63 appears at the opposite side of machine 50. The two side guards 62 and 63 extend upwardly from base top 58 at an angle of approximately 45 degrees and terminate at the bottom 65 of a slicing station 66; member 65 constitutes a part of the housing for slicing station 66. There is a conveyor/classifier guard (not shown) between side guards 62 and 63, below the bottom 65 of slicing station 66.

The slicing machine 50 of FIG. 1 further includes a computer display touch screen 69 in a cabinet 67 that is pivotally mounted on and supported by a support 68. Support 68 is affixed to and projects outwardly from a member 74 that constitutes a front part of the housing of slicing head 66. Cabinet 67 and its computer display touch screen 69 are pivotally mounted so that screen 69 can face either side of slicing machine 50, allowing machine 50 to be operated from either side. Cabinet 67 also serves as a support for a cycle start switch 71, a cycle stop switch 72, and a loaf feed on-off switch 73. Switches 71-73 and display/touch screen 69 are electrically connected to computer 54 in base 51.

The upper right-hand portion of slicing machine 50, as seen in FIG. 1, comprises a loaf feed mechanism 75 which includes an automated feed from the left-hand (near) side of the machine. Loaf feed mechanism 75 has an enclosure that can include a far-side manual loaf loading door 79 and a near-side automatic loaf loading door 78. Slicing machine 50 is equipped for automated loading of loaves from the near-side, as seen in FIG. 1, and can include manual loading of food loaves on the far-side of the machine. It will be understood that automated loaf loading may be provided on either or both sides of the machine.

A loaf feed guard 83 protects the nearside of the loaf feed mechanism 75 and shields mechanism 75 from a machine operator. There may be a similar guard on the opposite side of the machine. Behind loaf feed guard 83 there is a loaf lift tray 85 employed to load a food loaf into mechanism 75 during an automated loaf loading operation in machine 50 as described in detail below.

There are some additional switches seen in FIG. 1. An emergency stop switch,.87 for interrupting all operations of slicing machine 50 is mounted on the near side of loaf feed guard 83. There may be a similar emergency stop switch on the opposite side of the machine. A loaf lift switch 88 for initiating automated loading of a loaf from tray 85 into mechanism 75 is located immediately below switch 87. An emergency stop switch 89 is mounted on slicing station 66 on the near-side of machine 50. Switches 87, 88, and 89, and any counterparts on the opposite (far) side of slicing machine 50, are all electrically connected to the controls in enclosure 54.

As shown in FIG. 1, slicing machine 50 is ready for operation. There are food loaves 91 on tray 85, viewed through an opening or window 93 through the guard 83, waiting to be loaded into loaf feed mechanism 75 on the near-side of machine 50. Two, three, or even four food loaves may be stored on tray 85, depending on the loaf size. Machine 50 produces a series of stacks 92 of food loaf slices that are fed outwardly of the machine, in the direction of the arrow A, by conveyor classifier system 64. Machine 50 also produces a series of stacks 94 of food loaf slices that also move outwardly of the machine on its output conveyor system 64 in the direction of arrow A. Stack 92 is shown as comprising slices from a rectangular loaf, and stack 94 is made up of slices from a round loaf. Usually, both of the slice stacks 92 and 94 would be either round or rectangular. Stacks 92 and 94 may have different heights, or slice counts, and hence different weights; as shown they contain the same number of food loaf slices in each stack, but that condition can be changed. Both groups of slices can be overlapping, "shingled" groups or stacks of slices instead of having the illustrated straight stack configuration. Two, three or more loaves can be sliced simultaneously.

Figure 2:
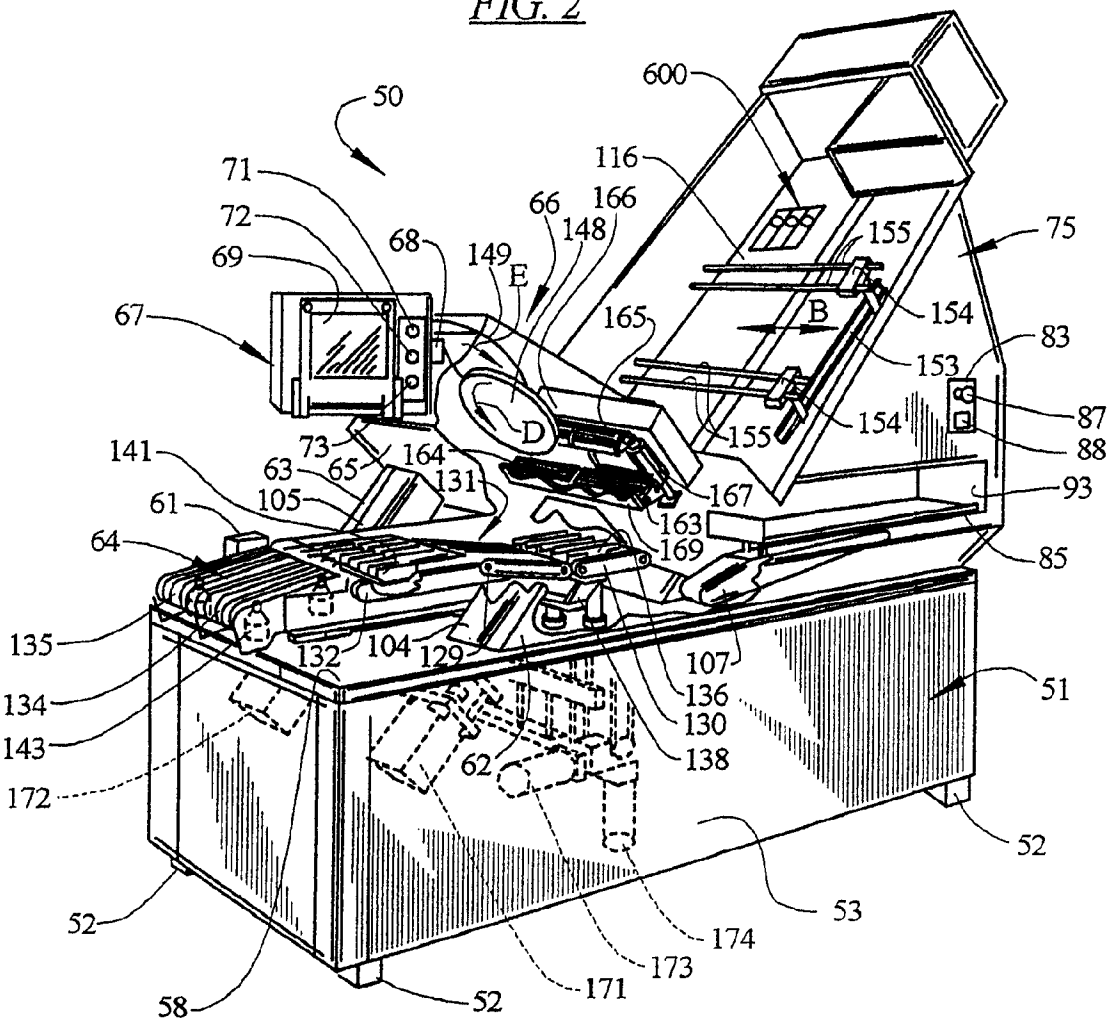
FIG. 2 is a perspective view of a slicing machine comprising a preferred embodiment of the invention, with portions of the covers on the machine base cut away.

FIG. 2 illustrates the slicing machine 50 of FIG. 1 with a number of the covers omitted to reveal operating components of the automated loaf feed mechanism 75 on the near-side of the machine. As shown in FIG. 2, there is a stack/shingle conveyor drive (not shown) located on the near-side of slicing machine 50. One part of the drive for slicing station 66 is enclosed within a support enclosure 104 on the near-side of machine 50. At the opposite side of slicing machine 50 there is an enclosure 105 for a knife drive. Slicing station drive enclosure 104 and knife drive enclosure 105 extend upwardly from table top 58 at an angle, preferably approximately 45 degrees, corresponding to the angular alignment of mechanism 75.

A loaf tray pivot mechanism 107 is located above top 58 of base 51 on the near-side of slicing machine 50. Mechanism 107 is connected to and operates the automatic loaf lift tray 85, as described below. A similar loaf tray pivot mechanism may be provided on the opposite side of slicing machine 50 in a machine equipped for automated loaf loading from both sides.

The principal support for one or more food loaves in mechanism 75, whether food loaf loading is being carried out on an automated basis or on a manual feed basis, includes a loaf support tray 116 that provides a continuous loaf support surface that is the bottom for the two or more loaf paths in slicing machine 50. A textured upper surface is preferred for support member 116 to improve sliding movement of a food loaf along those support members toward slicing station 66.

FIG. 2 illustrates the general arrangement of operating components within slicing head 66, one construction that may be used for conveyor/classifier system 64, and the drive motors for parts of slicing machine 50.

Referring first to conveyor/classifier system 64 at the left-hand (output) end of slicing machine 50, it is seen that system 64 includes an inner stacking or receiving conveyor 130 located immediately below slicing head 66; conveyor 130 is sometimes called a "jump" conveyor in some versions of machine 50. From conveyor 130 groups of food loaf slices, stacked or shingled, are transferred to a decelerating conveyor 131 and then to a weighing or scale conveyor 132. From the scale conveyor 132 groups of food loaf slices move on to an outer classifier conveyor 134. On the far side of slicing machine 50 the sequence is the same, but that side of system 64 ends with a second outer classifier conveyor 135 located next to conveyor 134.

Slicing station 66 is shown to include a rotating spindle or head 148. Head 148 is driven to rotate counterclockwise, as indicated by arrow D; the range of head speeds is quite large and may typically be from ten to seven hundred fifty rpm. A round knife blade 149 is shown rotatably mounted at a non-centralized location on head 148. Knife blade 149 is driven separately from head 148, rotating clockwise in the direction of arrow E. The range of knife blade speeds again is quite large and may typically be from ten to four thousand six hundred rpm. Blade 149 thus performs an orbital motion while it rotates. Other slicing head constructions may be used in machine 50, so long as the cutting edge of knife blade 149 moves along a predetermined cutting path in each cycle of operation. Involute-shaped blades such as described in U.S. Pat. No. 6,484,615, herein incorporated by reference, can also be used.

Loaf feed mechanism 75 further comprises a near-side sweep member 153 suspended from two sweep carriages 154 which in turn are each mounted upon a pair of sweep support rods 155. Sweep mechanism 153-155 is employed on the near side of machine 50. A corresponding sweep mechanism (not shown) may be located on the far side of a slicing machine equipped for automated loaf loading from both sides. Sweep carriages 154 are driven along rods 155 by belts, not shown in FIG. 2, as indicated by arrows B. Rods 155 are connected to a rotatable sweep actuator 156 for actuation thereby.

Slicing machine 50 further comprises a system of short conveyors for advancing food loaves from loaf feed mechanism 75 into slicing head 66. The short conveyor systems are actually a part of loaf feed mechanism 75. FIG. 2 shows two short lower loaf feed conveyors 163 and 164 on the near and far-sides of slicing machine 50, respectively. These short lower conveyors 163 and 164 are located immediately below two short upper feed conveyors 165 and 166, respectively. As used in describing conveyors 163-166, the term "short" refers to the length of the conveyors parallel to the food loaf paths along support 116-118, not to the conveyor lengths transverse to those paths. The upper conveyor 165 of the pair 163 and 165 is displaceable so that the displacement between conveyors 163 and 165 can be varied to accommodate food loaves of varying height. This adjustment is provided by a conveyor lift actuator 167 that urges conveyor 165 downwardly. A similar conveyor actuator is located on the far-side of machine 50 to adjust the height of the other upper short conveyor 166; the second actuator cannot be seen in FIG. 2.

The conveyor delivers the loaf leading ends into a shear edge and orifice member 169, described in detail in U.S. Pat. No. 5,974,925.

Some of the drive motors for the operating mechanisms in slicing machine 50 are shown in FIG. 2. The drive motor for the head or spindle 148 in slicing station 66 is a D.C. variable speed servo motor 171 mounted in the machine base 51. A similar servo motor 172 drives the knife blade 149. On the near side of machine 50 the loaf feed drive mechanism comprising the short loaf feed conveyors 163 and 165 is driven by a servo motor 174. A like motor 175 on the far side of machine 50 (not shown in FIG. 2) affords an independent drive for the "short" loaf feed conveyors 164 and 166 on that side of the slicing machine; see FIG. 4.

Figure 3:
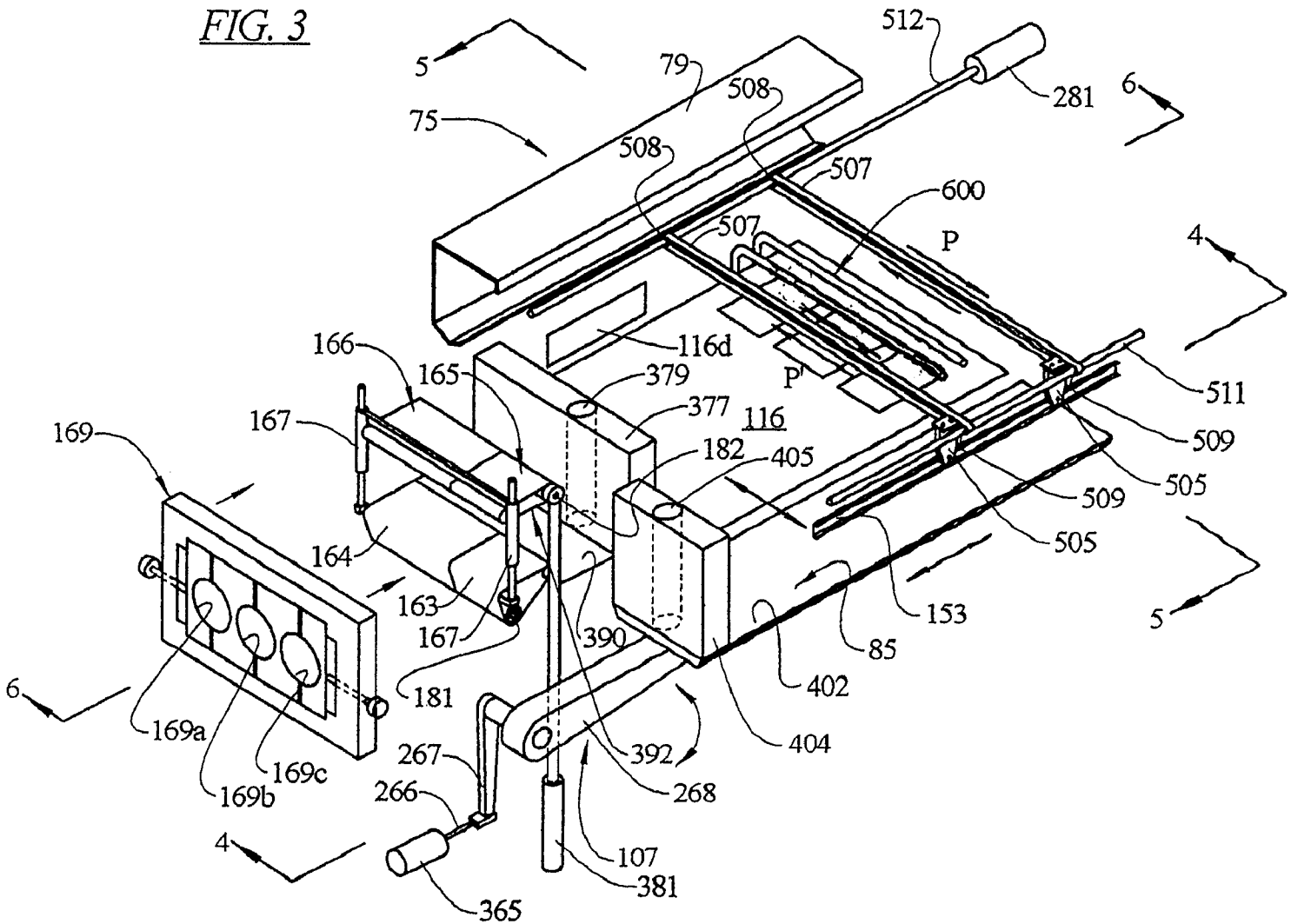
FIG. 3 is a simplified, partially exploded perspective view of operating components of the slicing machine of FIG. 1.

FIG. 3 affords a simplified schematic illustration of most of the loaf loading and loaf feed mechanisms in the slicing machine. Starting at the left-hand side of FIG. 3, it is seen that there is a loaf lift cylinder 365 having an actuating rod 266 connected to a crank 267 that in turn drives a loaf lift lever 268. These members are a part of the loaf lift mechanism 107 that lifts storage tray 85 from its storage position (FIGS. 1-2) into alignment with the support 116 on which food loaves rest during slicing. The loaf lift mechanism is actuated only during loaf loading; during a loaf feeding/slicing operation, cylinder 365 is not normally actuated and keeps tray 85 in its storage position. However, tray 85 may be elevated, ready to load a new loaf or loaves into feed mechanism 75, near the end of slicing.

The tray 85 includes a support surface 402 and an end wall 404. The end wall is shown schematically. It includes a plurality of vertically oriented rollers 405 (one shown) which reduce lateral drag on the loaves as they are transferred onto and off of the tray 85.

Figure 4:
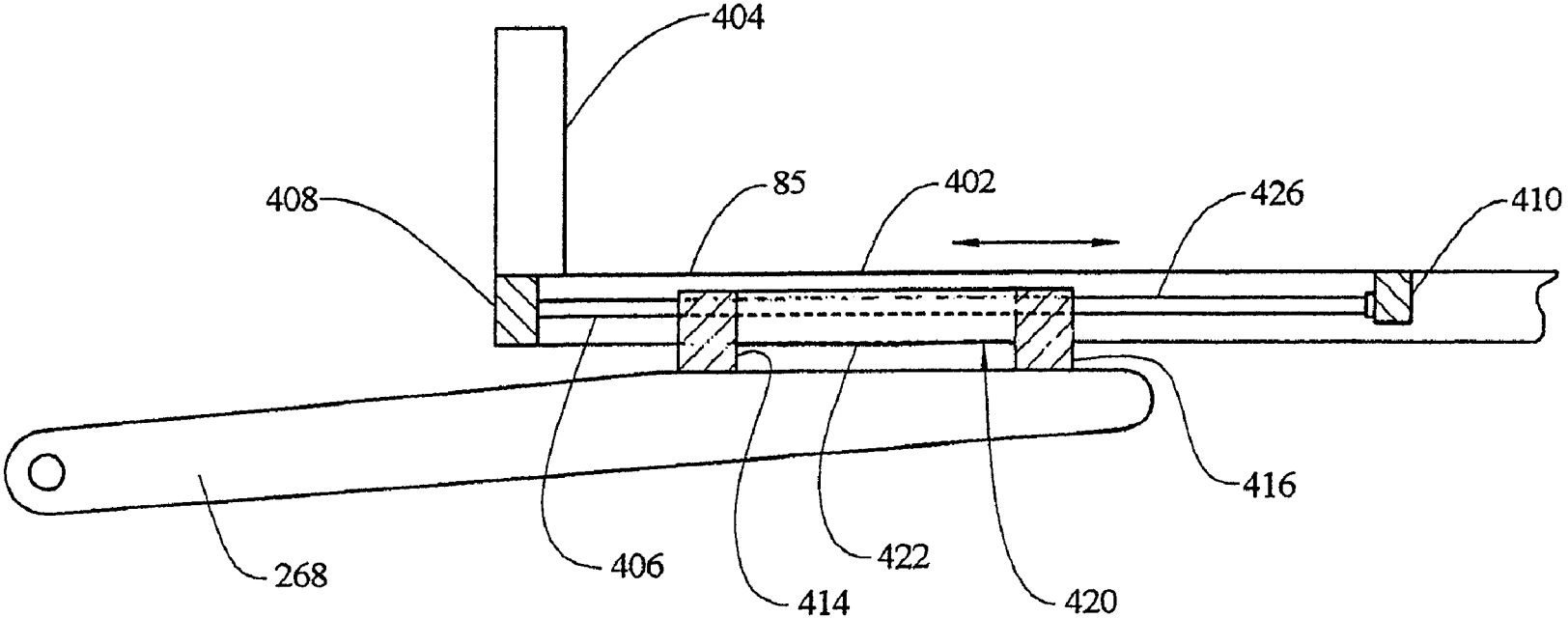
FIG. 4 is a simplified, schematic, fragmentary sectional view taken generally along line 4-4 of FIG. 3.

FIG. 4 illustrates in schematic from that the tray is mounted on a pair of parallel guide rods (one shown) 406 that are fixed at their ends to blocks or parts 408, 410 of the tray 85. The rods 46 are guided for sliding through brackets 414, 416 that are fixed to the lever 268. A pneumatic cylinder 420 has a cylinder portion 422 fixed between the brackets 414, 416 and a piston rod 426 that extends from the bracket 416 to the block 410 and is fixed to the latter. Thus extension or retraction of the rod 426 slides the tray 85 along the lever 268, along the rods 406.

The tray 85 is configured to be slidable on the bracket 268 so as to handle long loaves while minimizing the required machine longitudinal length and "foot print" when the tray is in the loading position (horizontal).

Returning to FIG. 3, the "short" conveyors 163-166, with the two upper "short" conveyors 165 and 166 are mounted on the housings of cylinders 167. Cylinders 167 have fixed shafts; air applied under pressure to the cylinders tends to drive their housings, and hence conveyors 165 and 166 down toward the lower conveyors 163 and 164. Downward movement of the upper conveyors is blocked by the shear edge member 169 that is specific to the size of loaves being sliced, so that each pair of the conveyors engages opposite sides (top and bottom) of a food loaf being sliced.

The sweep 153 is suspended from two hangers/carriages 505, each connected to a drive belt 507. There are structural members, not shown in FIG. 3, that afford further support for the hanger-carriages. Belts 507 are timing belts, each engaging a drive pulley 508 and an idler pulley 509. The idlers 509 are mounted on a shaft 511. The drive pulleys 508 are affixed to a shaft 512 rotated by a loaf sweep motor 513.

When a food loaf is first placed on support tray 116 it may tend to slide down toward slicing station 66; the support member 116 of transfer mechanism 75 is at an angle of 45 degrees as shown in FIGS. 1-2. The upper surfaces of the support member preferably have a textured finish to facilitate sliding of the food loaf. Each loaf path is closed off, near the slicing station 66, by the gate 377. Thus, a loaf entering mechanism 75 cannot slide down unexpectedly and prematurely into slicing station 66. The gate 377 comprises a plurality of rollers 379 (one shown), oriented in a direction perpendicular to the surface of the support tray 116, that allow the loaves to slide transversely with low friction drag in the lateral direction, from the loading tray 85 to the support tray 116. The gate 377 is raised and lowered by one or more pneumatic cylinders 381.

Between the gate 377 and the conveyors 163-166 a support 390 is provided having tapered lane dividers 392 which guide loaves laterally to move along pre-selected loaf paths into the conveyors. The orifice plate 169 also has side guides to direct the loaves into the corresponding orifices.

FIG. 3 illustrates a setup to slice three side-by-side loaves. Two loaves are driven by the conveyors 164, 166 and one loaf by the conveyors 163, 165.

The orifice plate 169 is arranged closely adjacent to the downstream side of the conveyors and includes three orifices 169*a*, 169*b*, 169*c* for guiding three loaves into the cutting plane. The orifice plate 169 is more completely described in U.S. Pat. No. 4,974,925 herein incorporated by reference.

At the beginning of an automated loaf loading operation, the loaf loading tray 85 is moved up to the position shown in FIG. 3, aligning loaves carried on the tray surface 402 with the support 116 on which the loaves rest while being sliced. The drive for pulley 508 and shaft 512 operates to drive the upper run of belt 507 to the right, in FIG. 3, in the direction indicated by arrows P. This moves the lower run of belt 507 toward the center of the slicing machine, to the left as seen in FIG. 3. The belt movement drives carriage 154 and suspension member 505 to the left along shafts 155 (FIG. 2) and moves sweep 153 pushing the new loaves onto the support 116 and into the loaf cutting paths of the slicing machine. The support 116 can have a surface contour that substantially aligns the loaves into respective side-by-side cutting paths.

The loaves rest against the gate 377, which is in the raised position. Thereafter, the gate 377 is lowered by activation of the cylinder(s) 381 and the loaves slide down the support 116 until the lead ends of the loaves abut the trailing ends of the preceding loaves 117*a* (FIG.7) being sliced. If the loaves are the initially loaded loaves, i.e., there are no preceding loaves 117*a* to which the initially loaded loaves can abut, the loaves slide down into the conveyors.

A further guide plate 116*d* (FIG. 3) is arranged to guide the loaves down the support 116.

Figure 5:
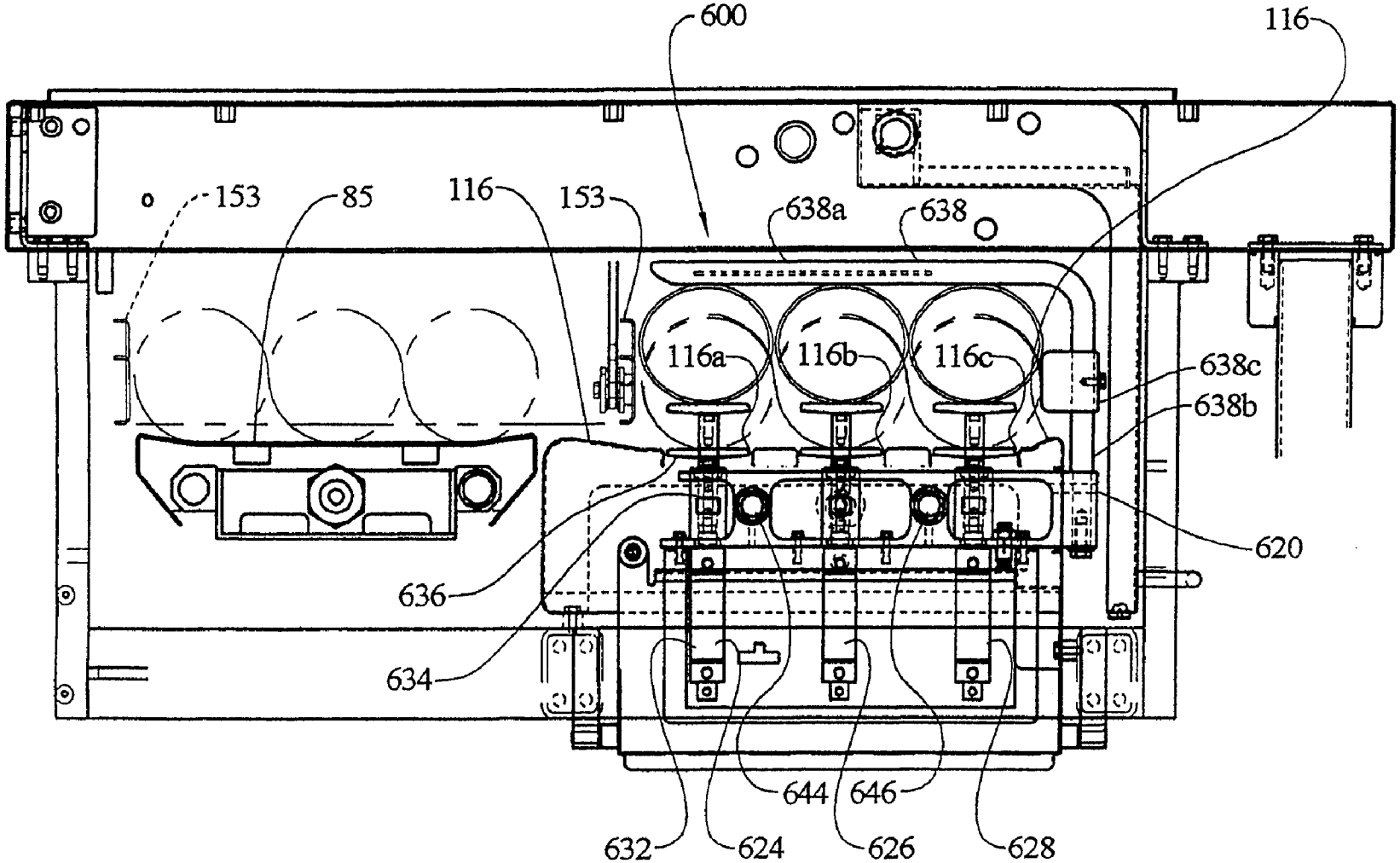
FIG. 5 is a fragmentary, sectional view taken generally along 5-5 of FIG. 3, with panels removed to view underlying components.
Figure 6:
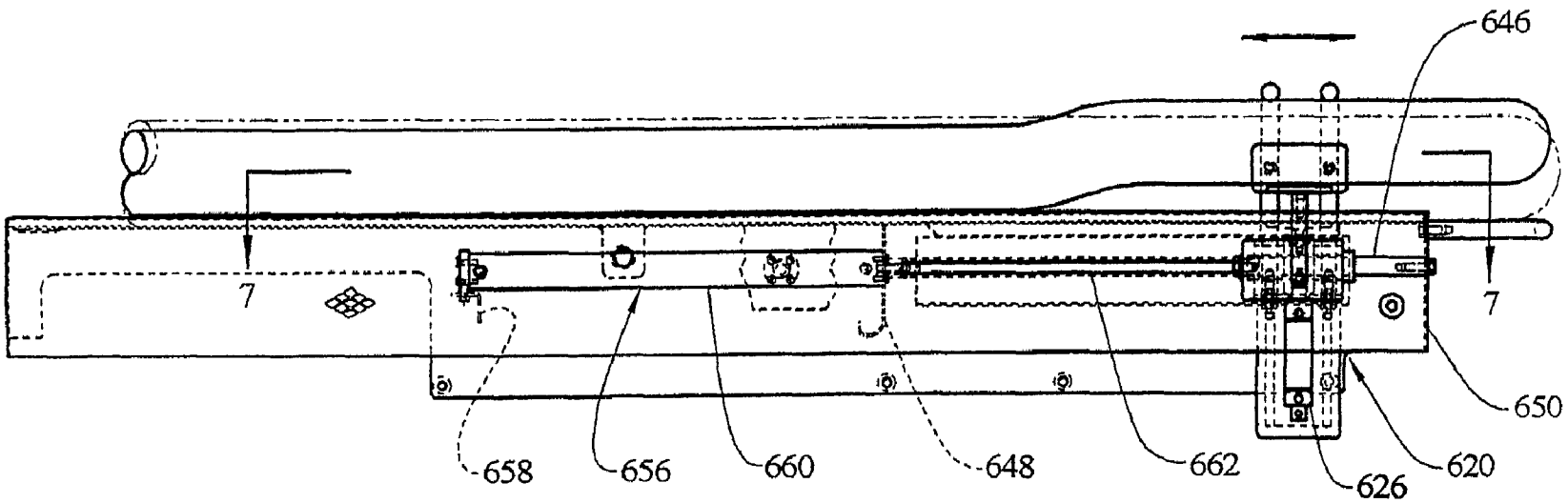
FIG. 6 is a fragmentary, sectional view taken generally along 6-6 of FIG. 3, with panels removed to view underlying components.
Figure 7:
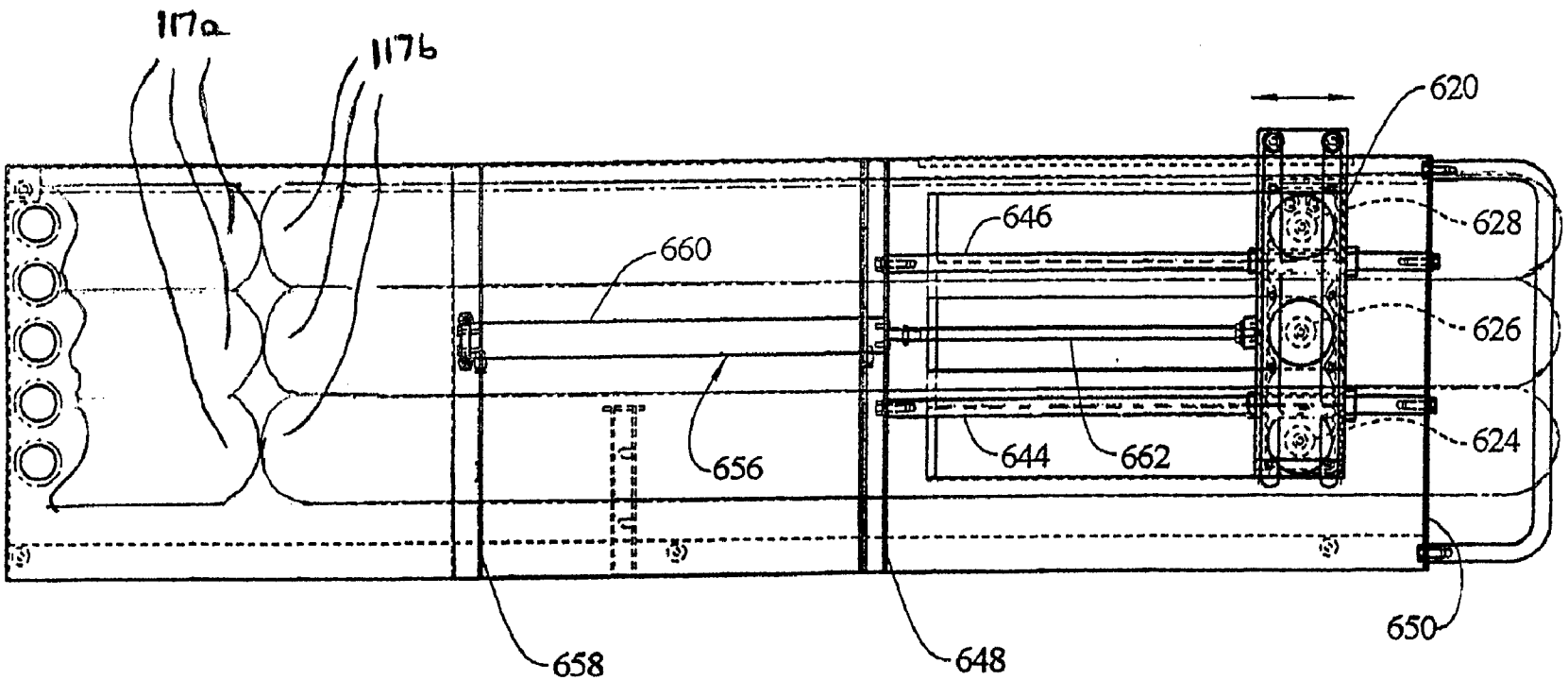
FIG. 7 is a fragmentary, sectional view taken generally along 7-7 of FIG. 6, with panels removed to view underlying components.

FIGS. 5-7 illustrate a seam alignment apparatus 600 according to the invention. The seam alignment apparatus includes a carriage 620 upon which carries three pneumatic cylinder assemblies 624, 626, 628. Each cylinder assembly 624, 626, 628 includes a cylinder body 632, an extendable piston rod 634, and a press plate 636. One or more (two shown) L-shaped bars 638, 639 are secured to the carriage 620 and each includes a horizontal leg 638*a* arranged above the press plates 636 and a vertical leg 638*b* attached to the carriage 620. The L-shape creates a lateral opening or clearance for introduction of the loaves in a lateral direction beneath the horizontal legs 638*a*.

A plastic block 638*c* is carried on the vertical legs 638*b*. The block 638*c* acts as a stop to guide the loaves into proper position on the support 116. The carriage 620 extends below the loaf support 116, wherein the piston rods 634 and press plate 636 extend through slots 116*a*, 116*b*, 116*c* through the loaf support 116. Below the loaf support 116, the carriage is journaled for sliding movement on two slide rods 644, 646. The slide rods are fastened at opposite ends to a crossmember 648 and to a flange 650, both attached to, or formed as part of, the support 116 or associated structure. A carriage transport pneumatic cylinder 656 is connected to the crossmember 648 and to a further crossmember 658 attached to, or formed as part of, the support 116 or associated structure. The cylinder 656 includes a cylinder body 660 and an extendable piston rod 662. The cylinder rod 662 is fastened to the carriage 620.

In operation, three loaves are moved from the loading tray 85 by the sweeper 153 to positions on the loaf support 116 above the pneumatic cylinder assemblies 624, 626, 628. The pneumatic cylinder assemblies 624, 626, 628 are activated to extend the piston rods 634, causing the press plates 636 to clamp the three loaves against the horizontal leg 638*a* of the L-shaped bars 638, 639. When the gate 377 is lowered, the carriage 620 is allowed to move with the loaves by force of gravity down the loaf support 116. If the loaves are the initial loaves, the three loaves are fed together into the short conveyors. As shown in FIG. 7, if the loaves are succeeding loaves 117*b*, the three loaves are fed together to abut the trailing ends of the preceding loaves 117*a*. If gravity is not a sufficient force, or if the speed or movement of the three loaves is desired to be controlled, the cylinder 656 could be used to drive the carriage 620 down the loaf support 116. Once the three loaves gripped by the apparatus 600 are engaged together by the short conveyors, the pneumatic cylinder assemblies 624, 626, 628 are deactivated, causing the press plates to retract to an elevation slightly below the support surface 116 which releases the loaves from the apparatus 600. The carriage-drive pneumatic cylinder 656 is then actuated to extend its piston rod 662 and drives the carriage 620 back up the loaf support 116 to a load position for the next three loaves.

The seam alignment apparatus 600 effectively loads the initial loaves into the short conveyors in a controlled manner which ensures the lead ends of the loaves are engaged at the same longitudinal position. For subsequently loaded loaves, the seam alignment apparatus acts to reestablish a common longitudinal alignment of the leading ends of the next three loaves, even if the trailing ends of the previous loaves have become misaligned for whatever reason. The invention is advantageous to longitudinally aligned seams between side-by-side loaf streams in a high speed slicing machine to simplify production of slices to be packaged.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A high speed food loaf slicing machine, comprising:

a slicing station including a knife blade and a knife blade drive driving the knife blade along a predetermined cutting path, and a loaf support for supporting a first food loaf and a second food loaf for movement along parallel first and second loaf paths, respectively, into the slicing station for repetitive slicing of both loaves by the knife blade;

a loaf feed drive for advancing an unsliced portion of the first food loaf and an unsliced portion of the second food loaf along the loaf path and into the cutting path, the loaf feed drive comprising a circulating upper conveying surface and an underlying circulating lower conveying surface, said upper and lower conveying surfaces circulating in opposite directions, the upper conveying surface for engaging an upper surface of the unsliced portion of the first food loaf and the unsliced portion of the second food loaf, and the lower conveying surface for engaging a lower surface of the unsliced portion of the first food loaf and the unsliced portion of the second food loaf; and a clamp device arranged to grip both the first and second loaves on the first and second loaf paths, said clamp device arranged to translate on the first and second loaf paths to move from a home position for receiving said first and second loaves to a feed position closer to the cutting path wherein ends of said first and second loaves are engaged by the loaf feed drive, and said clamp device independent of said loaf feed drive; and a control that is programmed to disengage the clamp device from the first and second loaves after the first and second loaves are engaged between the circulating upper and lower conveying surfaces of the loaf feed drive but before slicing of the first and second loaves in the cutting path is complete;

wherein said clamp device comprises a carriage that is arranged to translate along the first and second loaf paths on at least one elongated guide member, at least one pneumatic cylinder having a press member and mounted to said carriage, and a stop member mounted to said carriage, at least one of said first and second loaves located between said stop member and said press member, said pneumatic cylinder actuatable to clamp at least one of said first and second loaves between said stop member and said press member.

2. A high speed food loaf slicing machine according to claim 1, further comprising:

a loaf storage tray for storing said first and second food loaves ready for transfer to the first and second loaf paths; and loaf transfer means for moving said first and second food loaves from the loaf storage tray to the first and second loaf paths.

3. A high speed food loaf slicing machine according to claim 1, wherein said at least one pneumatic cylinder comprises a pair of pneumatic cylinders, each having a press member and each mounted to said carriage, and a stop member mounted to said carriage, said first and second loaves located between said stop member and said press members, said pneumatic cylinders actuatable to clamp said first and second loaves between said stop member and said press members.

4. A high speed food loaf slicing machine according to claim 1, comprising a carriage drive pneumatic cylinder connected to said carriage and to said frame, actuation of said pneumatic cylinder driving said carriage in the direction from the feed position to the home position.

5. A high speed food loaf slicing machine according to claim 1, wherein said stop member comprises an L-shaped bar having a horizontal leg disposed over said first and second loaves, and a vertical leg connected to said carriage, said L-shaped bar forming an opening with said carriage to permit the introduction of the first and second loaves into the first and second loaf paths.

6. A high speed food loaf slicing machine according to claim 1, comprising a loaf gate disposed between said first and second loaves and the loaf feed drive when the clamp device is in the home position, leading ends of said first and second loaves pressing against said loaf gate, said loaf gate actuatable to clear the first and second loaf paths to permit said first and second loaves to proceed toward said loaf feed drive, as said clamp device translates along said first and second loaf paths.

7. A high speed food loaf slicing machine according to claim 1, comprising:

a loaf storage tray for storing said first and second food loaves ready for transfer to the first and second loaf paths;

loaf transfer means for moving said first and second food loaves from the loaf storage tray to the first and second loaf paths; and in which the loaf storage tray and the loaf transfer means constitute an automated loaf loading mechanism, located on one side of the slicing machine.

8. A high speed food loaf slicing machine according to claim 7, wherein said loaf transfer means comprises a tilt mechanism for tilting the tray and raising trailing ends of loaves held thereon, and a translation mechanism for shifting loaves held thereon along said loaf tray to an overall raised elevation.

9. In a continuous loaf feed high speed food loaf slicing machine comprising a slicing station including a knife blade and a knife blade drive driving the knife blade along a predetermined cutting path, and a loaf support for supporting a first food loaf and a second food loaf for movement along parallel first and second loaf paths, respectively, into the slicing station for repetitive slicing of both loaves by the knife blade, wherein third and fourth loaves to be sliced are loaded on said first and second loaf paths directly behind said first and second food loaves respectively, with leading ends of said third and fourth loaves abutting trailing ends of said first and second loaves respectively, the improvement comprising:

a loaf feed drive adjacent to the cutting path for advancing an unsliced portion of the first food loaf and an unsliced portion of the second food loaf along the loaf path; and a clamp device arranged to grip both the first and second loaves on the first and second loaf paths, said clamp device arranged to translate on the first and second loaf paths to move from a home position for receiving said first and second loaves to a feed position closer to the cutting path wherein ends of said first and second loaves are engaged by the loaf feed drive, wherein once the first and second loaves are engaged by the loaf feed drive, the clamp device disengages from the first and second loaves;

said clamp device comprises a carriage that is arranged to translate along the first and second loaf paths on at least one elongated guide member, at least one pneumatic cylinder having a press member and mounted to said carriage, and a stop member mounted to said carriage, at least one of said first and second loaves located between said stop member and said press member, said pneumatic cylinder actuatable to clamp at least one of said first and second loaves between said stop member and said press member.

10. The improvement according to claim 9, wherein said at least one pneumatic cylinder comprises a pair of pneumatic cylinders, each having a press member and each mounted to said carriage; said first and second loaves located between said stop member and said press members, said pneumatic cylinders actuatable to clamp said first and second loaves between said stop member and said press members.

11. The improvement according to claim 10, comprising a carriage drive pneumatic cylinder connected to said carriage and to said frame, actuation of said pneumatic cylinder driving said carriage in the direction from the feed position to the home position.

12. The improvement according to claim 9, wherein said stop member comprises an L-shaped bar having a horizontal leg disposed over said first and second loaves, and a vertical leg connected to said carriage, said L-shaped bar forming an opening with said carnage to permit the introduction of the first and second loaves into the first and second loaf paths.

13. In a continuous loaf feed high speed food loaf slicing machine comprising a slicing station including a knife blade and a knife blade drive driving the knife blade along a predetermined cutting path, and a loaf support for supporting a first food loaf and a second food loaf for movement along parallel first and second loaf paths, respectively, into the slicing station for repetitive slicing of both loaves by the knife blade, wherein third and fourth loaves to be sliced are loaded on said first and second loaf paths directly behind said first and second food loaves respectively, with leading ends of said third and fourth loaves abutting trailing ends of said first and second loaves respectively, the improvement comprising:

a loaf feed drive adjacent to the cutting path for advancing an unsliced portion of the first food loaf and an unsliced portion of the second food loaf along the loaf path; and a clamp device arranged to grip both the first and second loaves on the first and second loaf paths, said clamp device arranged to translate on the first and second loaf paths to move from a home position for receiving said first and second loaves to a feed position closer to the cutting path wherein ends of said first and second loaves are engaged by the loaf feed drive, wherein once the first and second loaves are engaged by the loaf feed drive, the clamp device disengages from the first and second loaves;

a loaf gate disposed between said first and second loaves and the loaf feed drive when the clamp device is in the home position, leading ends of said first and second loaves pressing against said loaf gate, said loaf gate actuatable to clear the first and second loaf paths to permit said first and second loaves to proceed toward said loaf feed drive, as said clamp device translates along said first and second loaf paths.

14. The improvement according to claim 13, comprising:

a loaf storage tray for storing said first and second food loaves ready for transfer to the first and second loaf paths;

loaf transfer means for moving said first and second food loaves from the loaf storage tray to the first and second loaf paths; and in which the loaf storage tray and the loaf transfer means constitute an automated loaf loading mechanism, located on one side of the slicing machine.

15. The improvement according to claim 14, wherein said loaf transfer means comprises a tilt mechanism for tilting the tray and raising trailing ends of loaves held thereon, and a translation mechanism for shifting loaves held thereon along said loaf tray to an overall raised elevation.

* * * * *